US007344445B2

(12) United States Patent
McGovern

(10) Patent No.: US 7,344,445 B2
(45) Date of Patent: Mar. 18, 2008

(54) POOL GAME TABLE

(76) Inventor: James Robert McGovern, 63 B Independence Ct., Yorktown Heights, NY (US) 10598

( * ) Notice: Subject to any disclaimer, the term of this patent is extended or adjusted under 35 U.S.C. 154(b) by 86 days.

(21) Appl. No.: 11/326,378

(22) Filed: Jan. 4, 2006

(65) Prior Publication Data

US 2006/0199656 A1 Sep. 7, 2006

(51) Int. Cl.
*A63D 15/00* (2006.01)

(52) U.S. Cl. ..... 473/18; 473/7; 473/8

(58) Field of Classification Search ..... 473/18, 473/1, 4, 6, 7, 10, 14, 20; 273/309
See application file for complete search history.

(56) References Cited

U.S. PATENT DOCUMENTS 4,147,345 A * 4/1979 McGovern ..... 473/8

5,135,218 A * 8/1992 McGovern ..... 473/7

* cited by examiner

*Primary Examiner*—Mitra Aryanpour

(57) ABSTRACT

The circular pool table with an elongated playing surface, parallel, spaced apart side cushions, and segment pocket units that can be pivoted upright to expose a pocket, is improved and now embodies adjustable playing surface and side cushion brackets, mechanical pocket closing apparatus, ball return deflectors, and troughs, a ball retreval pan, electro magnetic pocket open and closing apparatus, and the apparatus of a new game system, called 7 CUE POOL, that includes, 7 Red, 7 White, and 7 Blue consecutively numbered balls, a combination ball rack and jackpot play, diagram selector, spinner, a sliding arrow type score indicator, a distinctly marked jackpot cue ball, and a setof instructions ahd rules for playing the new game, 7 CUE POOL.

14 Claims, 13 Drawing Sheets

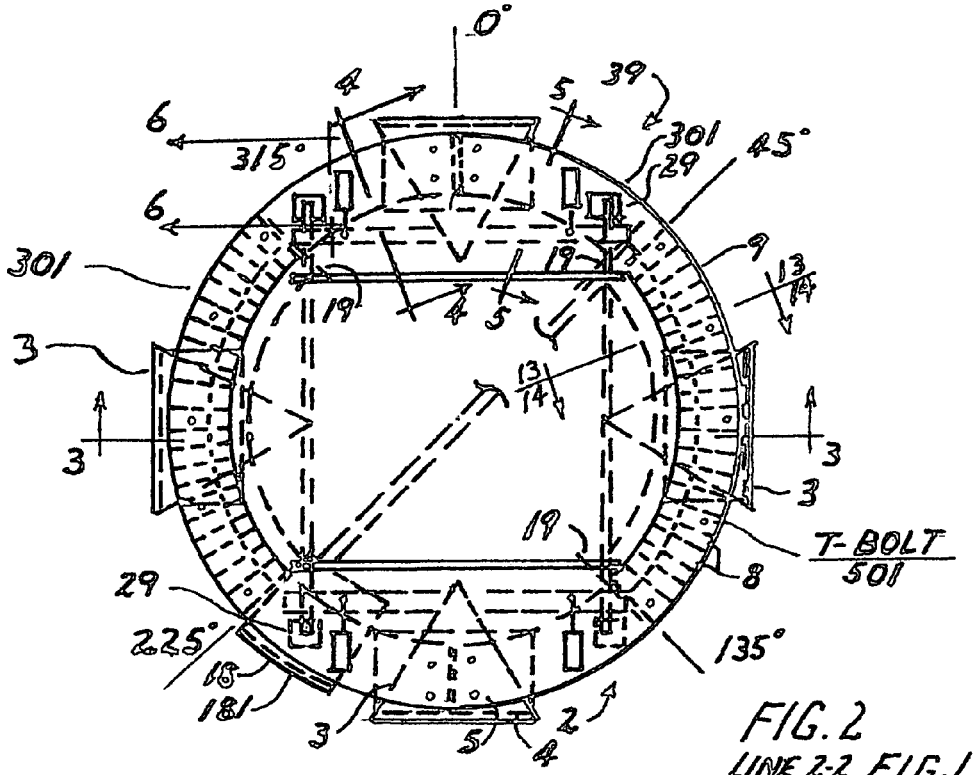
FIG. 2
LINE 2-2 FIG. 1
FIG. 4
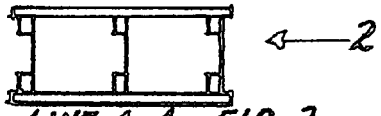
LINE 4-4 FIG. 2
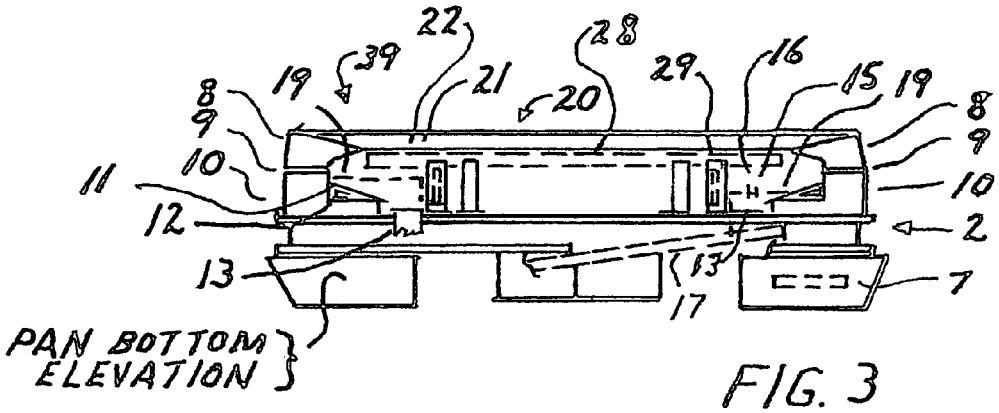
FIG. 3
LINE 3-3 FIG. 2

LINE 6-6 FIG. 2

LINE 5-5 FIG. 2

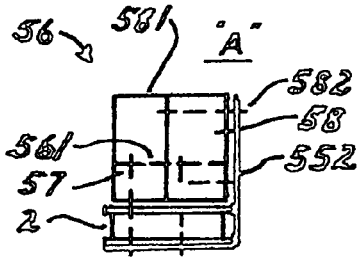
FIG. 8 (LINE 8-8 FIG. 7)
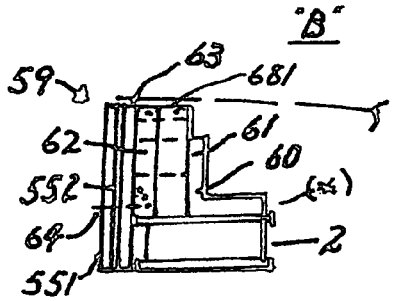
FIG. 9
(LINE 9-9 FIG. 7)
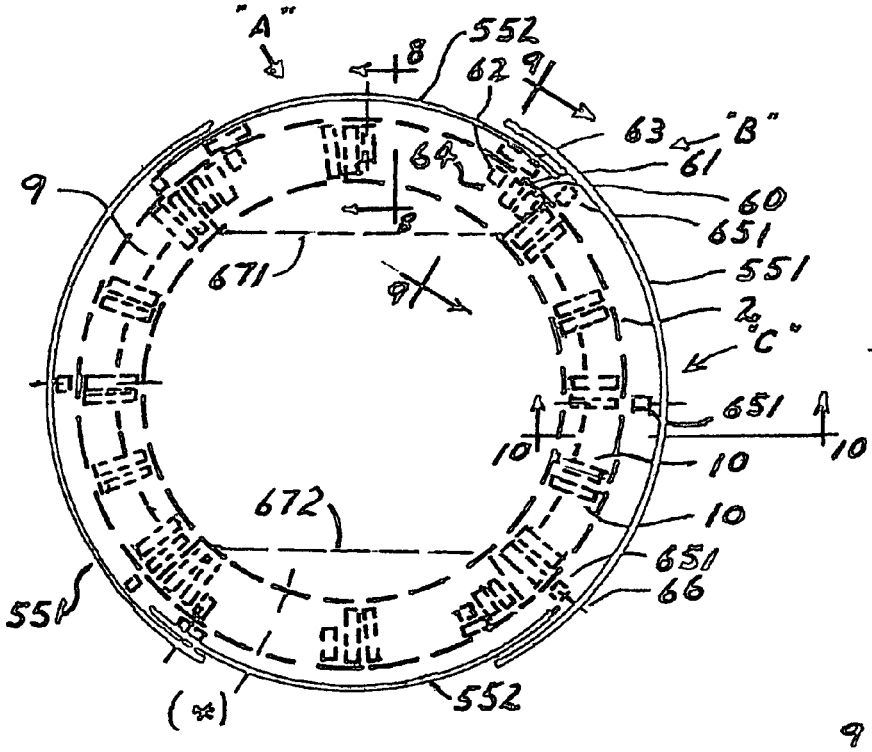
FIG. 7
LINE 7-7 FIG. 1
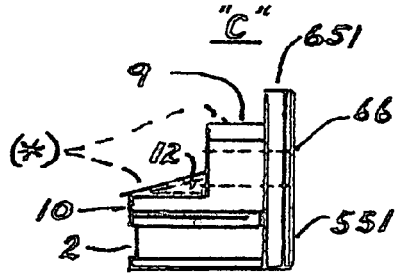
FIG. 10
LINE 10-10 FIG. 7
NOTE:
(*) ITEMS SHOWN FOR REF. ONLY

LINE 12-12 FIG. 11

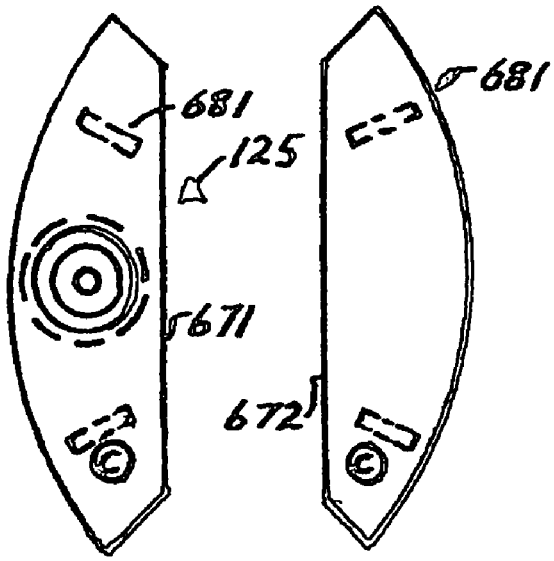
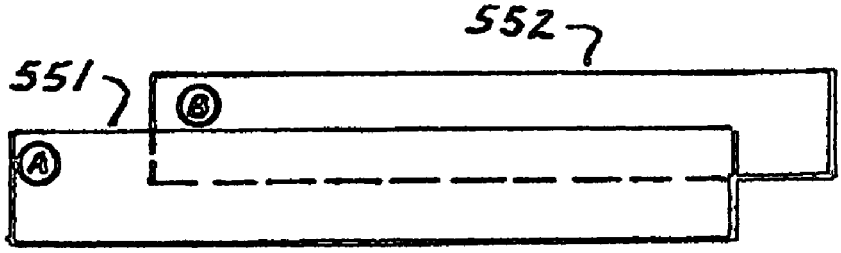
FIG. 19

LINE 20C-20C

LINE 21B-21B
OF FIG. 21A

POOL GAME TABLE

This is a Provisional application for patent on an improved embodiment of the round pool table described in U.S. Pat. No. 5,658,202 of Aug. 19, 1997.

BACKGROUND OF THE INVENTION

The State Of The Art Round Pool Table provides many features that require hand operation while a game is being played, such as opening a segment pocket unit to expose a pocket, and closing the pocket, again by hand, after a ball is sunk.

Hand operation of table features, it seems, slows a games play action. Therefore, it is the object of the present invention to provide new and novel table features that will noticeably reduce the need for game players to pause and hand operate a table feature during a game.

SUMMARY OF THE INVENTION

A primary object of the present invention is to provide segment pocket units that have straight "bumper cushions", to allow more precise banking of pool balls.

Another object of the invention is to provide improved U.S. Pat. No. 5,658,202 Embodiments, that facilitate opening or closing a segment pocket for use during game play by motor and electromagnet apparatus that is actuated by the player pushing a button on a remotely located panel.

And another object of the invention is to provide brackets that facilitate precise placement and stabilization of the tables elongated, side of playing surface, table cushions.

Still another object of the invention is to provide each end of the pool table with panels, one that has push buttons that actuate, that is open or close, the segment pockets disposed on the table's immediate end, and one that has push buttons that actuate, that is open or close, the segment pockets disposed at the opposite end of the table.

Another object of the invention is to provide segment pocket actuating buttons that open a corresponding segment pocket when pushed to the left and then close that corresponding segment pocket when pushed to the right.

Another object of the invention is to provide the game table with a frame that is made in the shape of a flat I-Beam ring and that supports an elevated, circular plate, that that flexibly oriented segment pocket units can be clamped to.

And another object of the invention is to provide a horizontal, inclined, ball deflector plate beneath each group of 21 segment pocket units.

Still, another object of the invention is to provide a ball return trough and ball retrieval pan, ball return system.

Another object of the invention is to provide a structurally framed, laminated, playing surface panel unit that is secured with anchor bolts, to cross beams that are carried by brackets that are clamped to the I-Beam frame ring.

Still, another object of the invention is to provide brackets that will flexibly support the table's playing surface panel and is support beams to the table's structural ring frame.

And another object of the invention is to provide bracket supported enclosure skirts.

Another object of the invention is to provide removable table top enclosing plates.

And another object of the invention is to provide multiple slide arrow point type score keeping indicators.

And still, another object of the invention is to provide a combination, 21 ball, rack and Jackpot wheel spinner, that provides, play selection, of any one of the 21 diagramed Jackpot plays, that are displayed on the rack base, and that is used as the play that must be executed, in order to determine the winner of the missed shot points that are accumulated in a jackpot and awarded to the player who successfully executes a Jackpot play.

And another object of the invention is to provide an electrical circuit diagram that will show two, 21 segment pocket unit open and close push button panels located on the table top, at each end of the table, and the related apparatus wiring, provided to open and close segment pockets by motor and electromagnetic apparatus.

These objects, and others not included, will be accomplished when the invention is constructed, within the scope of the appended claims, and in accordance with the accompanying drawings.

DESCRIPTION OF THE DRAWINGS

FIG. 2 is a section from FIG. 1 along line 2-2 that shows a plan view of several new table features, including bracket supported elongated playing surface area side cushions, and a bracket and beam playing surface area support system, carried by a new, table supporting structural ring frame.

FIG. 3 is a section from FIG. 2 taken along line 3--3 that shows support elements that carry the table's segment pocket units, that is 21 units, at each end of the table playing surface area.

FIG. 4 is a cross section of the table's new structural support ring frame, taken along line 4--4 of FIG. 2.

FIG. 7 is a top plan view section taken along line 7--7 of FIG. 1 that shows the placement of the table's playing area, the simulated placement of the table's top cover panels, the spacing of twin, segment pocket unit support brackets, and the horizontally disposed semicircular plates that support the segment pocket units.

FIG. 8 is an elevation view of the table skirt panel (A) type bracket.

FIG. 9 is an elevation view of the table skirt panel (B) type bracket.

FIG. 10 is an elevation view of the table skirt panel (C) type bracket.

FIG. 19 is a plan view of the table's top and side enclosure panels.

PREFERRED EMBODIMENT

Figure 1:
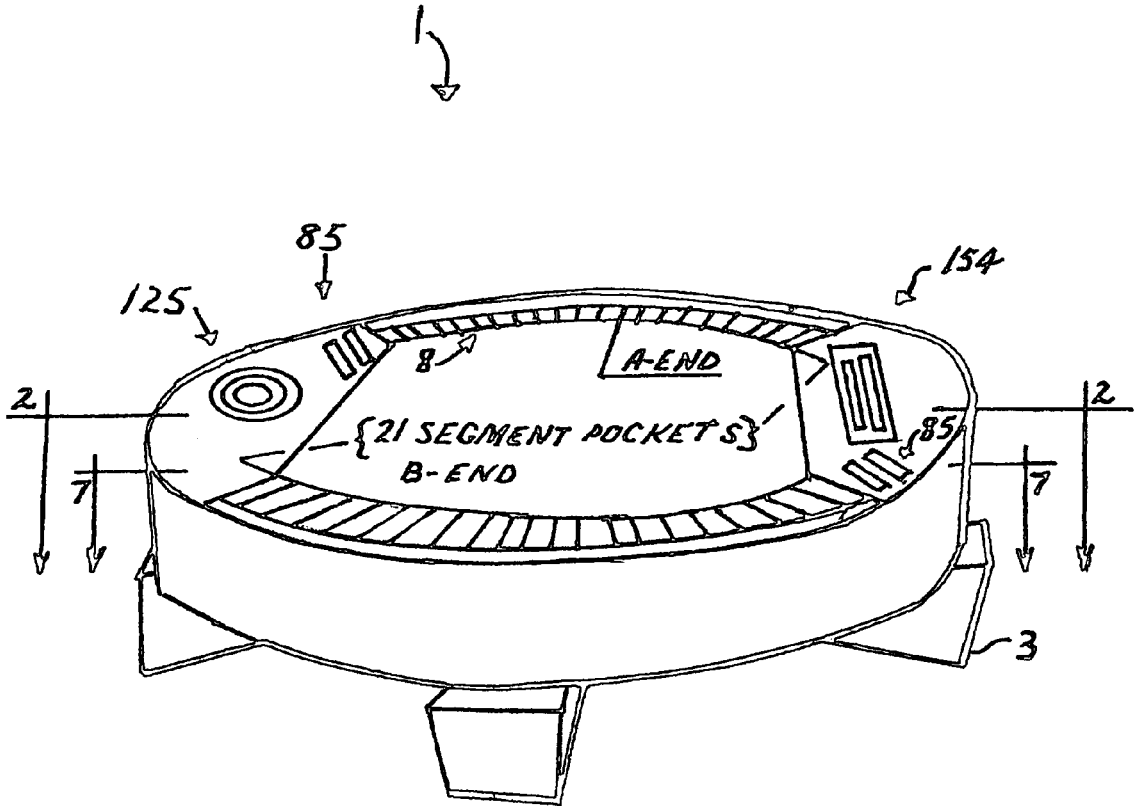
FIG. 1 is a perspective view of the improved game table that shows a new combination ball rack/jackpot play selector spinner, a new multiple sliding arrow pointer score keeping unit, the A-end and B-end of the table, and two segment pocket actuation switch panels at each end of the table.
Figure 6:
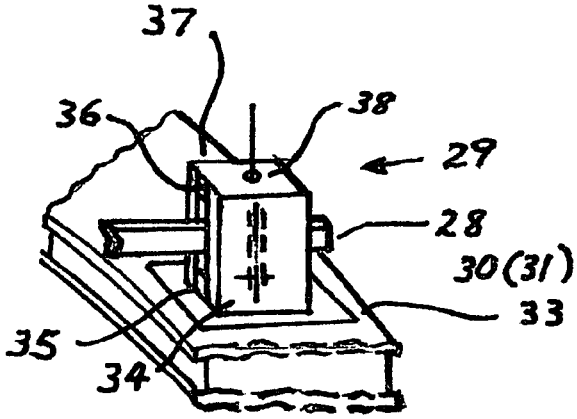
FIG. 6 is a cross section taken along line 6--6 of FIG. 2 that shows a perspective view of a bracket and beam from the system that supports the table's playing surface area structural panel.

With reference to the various drawings that are presented herewith, FIGS. 1 thru 21, proceed and note, conceptually, in setting out to construct a prototype of this invention of an improved Pool Game Table, that the specification in summary, includes the following embodiments:

A) A new table structural ring frame (2) system that will provide support of all table (1) elements.

B) A new system for supporting pluralities of game table segment pocket-forming units (8).

C) A new system for the return and retrieval of game balls that a player sinks in the segment pockets (8) that are opened for play.

D) A new way of making and bracket supporting a game table playing surface area panel (20) to the table's structural ring frame (2).

E) A new way of providing a game table's elongated, side of playing surface, bracketed rebound cushion assemblies (39) that are supported to the table's structural ring frame (2)

F) A new way of supporting table (1) enclosing skirts (551 & 552), and top panels (123-1 & 2) to the table's structural ring frame (2).

G) 1. A new segment pocket unit (8) mechanical mechanism (77) that holds a segment pocket's tongue (72) in an open pocket position and is actuated by a falling ball (67), to close the open pocket (8).

2. New motor apparatus (86) to open each segment pocket (8) and new electromagnetic apparatus (83) to close each segment pocket (8).

H) New table top panels (85) that carry push button unit switches (97) that a player can use to open or close corresponding segment pockets (8).

I) Circuit diagrams (120), and (971) that show how to electrically wire the new electromagnetic segment pocket open and close apparatus.

J) Table (1) skirts (551 & 552), and table top panels (123-1 &2).

K) New table game system apparatus that includes, ---1--- a combination Ball Rack/Jackpot Winning Play Selector unit (125), ---2---, a simplified Multiple Slide Arrow Game Point Counter, and ---3---, a new game system facilitated by this invention.

Commence with Embodiment A)

Proceed now to the making process, and while continuing our reference to FIG. 1, and expanding our reference to include the 2, 3, and 4, Figures, make an improved table (1) structural ring frame (2) that is set on 4 triangular shaped legs (3), and that supports all of the table's components.

The ring (2) is made of 4 semicircular sections (301) that are held in the ring shape by 4 gusset plates (4) that are thru bolted (5) to the joints of the sections (3).

Continuing, make 4 triangular shaped legs (3) to support the ring (2).

Provide a horizontally disposed plate (7) on brackets, within the interior of the leg (3), to stabilize each leg as shown in FIG. 3.

Embodiment B FIGS. 2, 3, & 7.

Again, continuing, construct a system that provides elevated segment pocket unit (8) support to the table's structural ring frame (2).

Provide 2 semicircular segment pocket support plates (9), one extending from the 45 degree radius line of the ring (2) to the 135 degree radius line of the ring (2), and the other extending from the 225 degree radius line of the ring (2), to the 315 degree radius line of the ring.

Support each segment pocket unit support plate (9) by 5 vertical pairs of L shaped brackets (10) that are spaced apart. See FIG. 7.

Thru bolt (501) the plate (9) and bracket assemblies to the ring (2). See FIG. 2.

Each of these horizontally disposed plates (9) support 21 segment pocket units (8), that are clamped, individually to the plate (9).

Embodiment C FIGS. 2, 3, 7, & 10.

Continuing, provide a semicircular ball drop deflector plate (11), one corresponding to each segment support plate (9), and the plane of which is disposed sloping downward, toward the center of the ring (2), blocked up by a plurality of wedges (12), and supported to the horizontal members of the L bracket (10) pairs.

Provide a semicircular shaped ball return trough plate (13), one corresponding to each ball drop deflector plate (11), and the plane of which is disposed sloping from an elevation high point on the right to an elevation low point on the left.

Support each trough plate (13) by flat brackets (14), horizontally disposed, one supporting the high end of the trough (13) to the top surface of the ring (2), and the other supporting the low end of the trough (13), to the bottom surface of the ring (2).

Along the outside edge of each trough plate (13), provide a narrow rail (15) that is spaced above the trough (13) plane, supported by five vertical posts (16) that are spaced evenly apart.

Continuing, complimentary to the ball deflector and trough assembly on each side of the ring (2), provide a trough extension (17) and ball retrieval pan (18) assembly that will facilitate transport of a game ball that is sunk in a segment pocket (8), and deflected onto either sloping trough (13) plate, from the trough's low end point, to a ball pan (18), for retrieval.

The trough extension (17), see FIG. 2, dimensionally capable of allowing a pool ball to roll through it, has elongated bottom and side pieces, that resemble a squared U in cross section.

The trough extension (17) is sloped downward between the low end points of the troughs (13).

Support the trough extension (17) ends, upper and lower, by suspending them by rod and nut, from the structural ring (2).

At the low end of the trough extension (17), provide a ball retrieval pan (18), that has a raised containment rim (181) around its perimeter.

Suspend the pan (18) by rod and nut from the ring (2) so that it will catch and contain balls that roll through the extension (17), and drop onto its (18) surface.

Provide ball roll limit plates (19), not shown, at the top of each trough plate (13), and at the trough and extension points of intersection.

Embodiment D FIGS. 2, 3, 6, 11, & 12.

Continue by providing a table playing area surface panel unit assembly (20) that is comprised of a top panel (21) and a bottom panel (22), that are laminated, by gluing to a plurality of equally spaced apart horizontal stringers (23).

Provide a plurality of short, stringer stabilizer blocks (24), glued perpendicularly between the stringers (23).

The playing area surface panel assembly (20), has four anchor units (25), each unit comprised of two spaced apart vertically downward extending, from the bottom of the panel, rods (26), and a containment plate (27), so that while a cross beam (28) is threaded through the space between the rods (26), in an across-the-panel direction, the containment plate (27), which has two aligned rod holes (291), is threaded onto the rods, and secured by a nut on each rod (26), to facilitate anchoring the playing surface panel (20) to a cross beam (28).

Again, continuing, provide two, table playing surface area panel (20) support beams (28).

Each beam (28) is carried at each of its ends by an adjustable bracket, (29), supporting the beam to the structural ring (2).

Each beam (28) is provided with 2, vertical bracket bolt holes, 30 and 31, each spaced the same distance from the beam end.

In providing the adjustable beam support brackets, each bracket unit (29) is comprised of a base plate (33) and two vertical side member plates (34) that are held spaced apart by a horizontal stationary spacer base (35), that is the same width as the support beam (28).

Provide a T shaped bracket top piece, where the vertical member (36) is the same width as the beam (28), and the horizontal top member (37) extends to the outside edges of the vertical side plates.

Again with reference to FIG. 6, provide a vertically disposed, inverted, round head bolt (38) that extends through the horizontal, bracket top piece (37), and vertical member, and passes loosely, vertically, down through a vertical hole in the beam (28).

The upper end of the bolt (38) while extending above the top surface of the horizontal member (37), carries a large washer and winged nut.

The bracket base plate (33) is fastened by clamp to the structural ring (2).

The beam (28) ends can be moved, within limits, up or down, laterally, and or directionally, when establishing the table playing surface in a level stabilized position.

Figure 5:
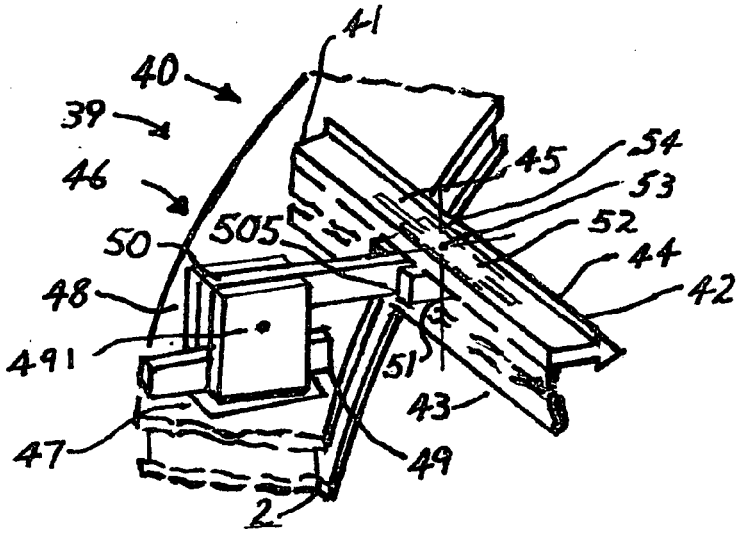
FIG. 5 is a cross section taken along line 5--5 of FIG. 2 that shows a perspective view of a bracket from the system that supports the table's elongated, playing surface area side cushion.

Embodiment E FIGS. 2, 3, & 5.

Now, continuing, provide two table playing surface area elongated, side cushion and bracket, unit (39) assemblies. See FIG. 2, FIG. 3, and FIG. 5.

For each cushion and bracket assembly (39), provide an elongated cushion base unit (40), comprised of a long rectangular structural member (41), a front stabilizer strip (42) that is glued to the leading edge of the structural member (41), and a back stabilizer strip (43) that is glued to the trailing edge of the structural member (41).

The back stabilizer strip (43), is a wide rectangular member that stabilizes the base unit member (40) to the top surface of the structural ring (2).

Glue a long length of rubber cushion (44) to the face of the front stabilizing strip (42), and provide long narrow lengthwise slots (45), in structural member (41), one spaced from each of it's (41) ends.

Now proceed to provide two support brackets (46) for each cushion base unit (40). Refer to FIG. 5.

Each support bracket (46) is comprised of a base plate (47), two vertical rectangular side pieces (48) that are held, glued to a horizontal spacer strip (49) to form a U shaped configuration, and a transverse take-up bolt (491), with a winged nut, that passes horizontally through the side pieces (48), just below the bottom surface of the bracket arm (50) that is disposed, in the U, held between the tops of the side pieces (48), extending horizontally outward. Provide a short widening strip (505) on each side of an arm (50), and at the end of the arm (50), drill a vertical hole (51) through the bracket arm (50), spaced from the unfastened, widened end of the arm (50).

Place the elongated cushion and bracket unit assemblies (39), along the sides of the table playing area (20).

Clamp the two brackets (46),—see FIG. 2— of each assembly (39), spaced apart, to the table structural ring (2), with the arms (50) oriented, pointing toward the opposite side of the table (1).

Referring again to FIG. 5, provide two pair of thin sliding plates (52) for each cushion structural member (41).

Drill a hole (53) through the center of each plate.

Now, with an arm (50) vertical hole (51) aligned with the corresponding structural member (41) slot (45) and also aligned with the holes (53) in the thin sliding plates (52), install a vertical rod (54), with nuts, in the aligned holes of the assembly, to thus achieve, two horizontally disposed, elongated playing surface area bracket and cushion unit assemblies (39), and their cushion line of contact, capable of being flexibly stabilized.

Embodiment F FIGS. 7, 8, 9, & 10.

Proceeding, provide three types, an A, a B, and a C, of structural table skirt brackets, to support the table skirts to the table structural ring frame (2).

Note in referring to FIG. 7, that skirt (551) is shorter than skirt (552).

Provide two of the A type brackets (56).

The A type bracket (56) is comprised of a horizontally disposed base member (561) that is thru bolted (57) to the structural frame (2), a vertical member (581), that is fastened by bolts w/nuts to the horizontal member (561), and a vertical narrow member (58) that is bolted to the (561) and (581) members.

Note in FIG. 8 that the outside edge of vertical narrow member (58) is aligned with the outside edge of the structural frame (2), and that thru bolts (582), extend outward far enough to engage and hold a skirt panel (552). With reference to FIG. 9, provide four B type brackets (59).

The B type bracket (59) is comprised of a narrow horizontal base member (60) that is thru bolted (57) to the structural frame (2), a vertical narrow long member (61) that is fastened by bolts, w/nuts, to the base member (60), and a still narrower member (62) fastened to (61) by bolts w/nuts and a long narrow strip member (63), that is positioned outside the structural ring (2), fastened to (62) by horizontal thru bolts (64) that extend outward far enough to engage and hold a skirt panel (552).

Continuing our reference to FIG. 7, and with reference to FIG. 10, provide six C type brackets (651).

The C type bracket is comprised of a vertical member (651) that is fastened in each case to an adjacent segment pocket plate support L shaped bracket (10).

The C type bracket (651) is fastened by 2 elongated bolts (66), w/nuts, that extend outward far enough to engage and hold a skirt panel (552).

---Examiners Note 1.---

Table enclosing elements including skirts (551) and (552), and table top panels (671) and (672), and panel fastening blocks (681), are specified below.

Embodiment G-1 FIGS. 1, 13, 14, & 15.

Continuing, with reference to FIG. 1, proceed to provide 21 push button actuated electro magnetic segment pocket units (8), for the A end of the table (1), and 21 push button actuated electro magnetic segment pocket units (8), for the B end of the table (1).

Provide segment pocket units (8) comprised of a unit hinge base (69), which consist of two vertical side piece members (70) that are glued to and stabilized by a horizontal base member (71), and a hinged segment tongue (72) that has a short length of standard rubber cushion (441) glued to its unfastened end.

The segment tongue (72) is supported at one end by a transverse pin (73), to the hinge base (69) vertical side pieces (70).

In its fastening, the segment tongue (72) is disposed in a near horizontal position, Its cushion edge (441) in horizontal alignment with adjacent segment pocket units that are each mounted on plate (9), on which the units (8) are provided a common mounting level.

When a segment tongue (72) is elevated, the space that its cushion end (441) occupied while the segment tongue was horizontal, becomes a segment pocket opening.

Figure 14:
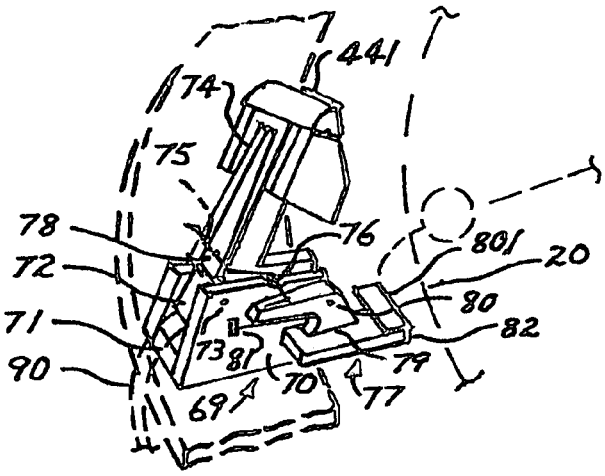
FIG. 14 is an elevation view of a table segment pocket unit in the open pocket position that shows a simulated actuation of a table segment pocket, pocket closing mechanism by a ball, as the bail drops into the open pocket.
Figure 12:
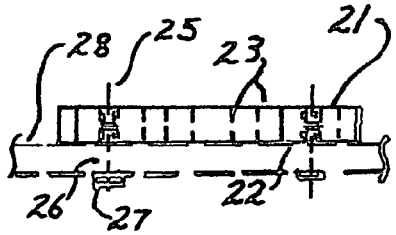
FIG. 12 is a cross section taken along line 12--12 of FIG. 11 that shows the structural support members of the table playing area surface, panel unit.
Figure 13:
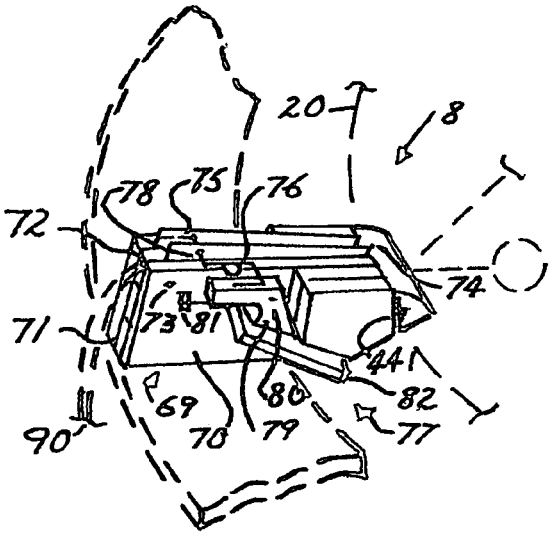
FIG. 13 is an elevation view of a table segment pocket unit in closed position.
Figure 11:
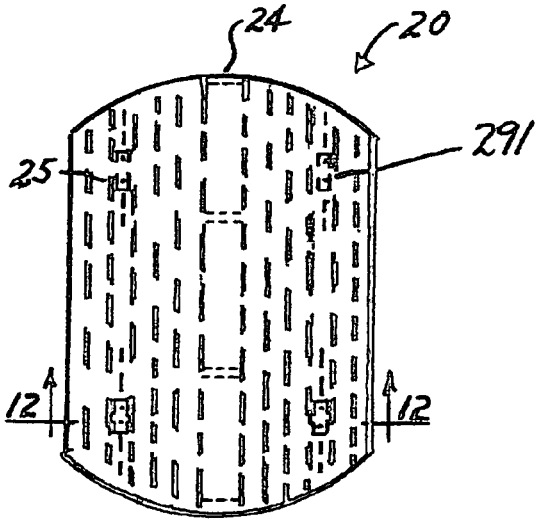
FIG. 11 is a top plan view of the table playing area surface panel.

Continuing, as shown in FIGS. 13, & 14, provide each segment tongue (72) with a top mounted ball launch track (74) that will allow randomly rolling game balls onto the table playing surface (20).

Provide each pocket unit (8) with a segment tongue (72) elevation hold lever (75) and corresponding hold lever groove (76).

Also provide a ball drop, segment closing mechanism (77).

The segment tongue hold lever (75) is hinge fastened to the segment tongue top surface (72), contained in a transverse hole (78) at the base of the segment launch track (74).

The ball drop segment closing mechanism (77), is comprised of a cam (79) that is hinge mounted on a pin (80), and carries a counter weight (81) aft of the pin and a ball pan (801) that is fastened to an arm (82) that extends forward of the pin (80).

Operationally, mechanically, if the segment were elevated by hand to a near vertical position, the hold lever (75), would trail along the top edge of the segment pocket's unit base side member (70), pass over the hold lever groove, (76), and then released, the hold lever would drop into the groove, thus causing the segment tongue (72) to be held in an elevated, open pocket, position.

Then if a ball were to drop into the segment pocket space, engaging the ball pan (801), the ball drop segment closing mechanism (77) would be actuated and the segment pocket (8) would close.

Figure 15:
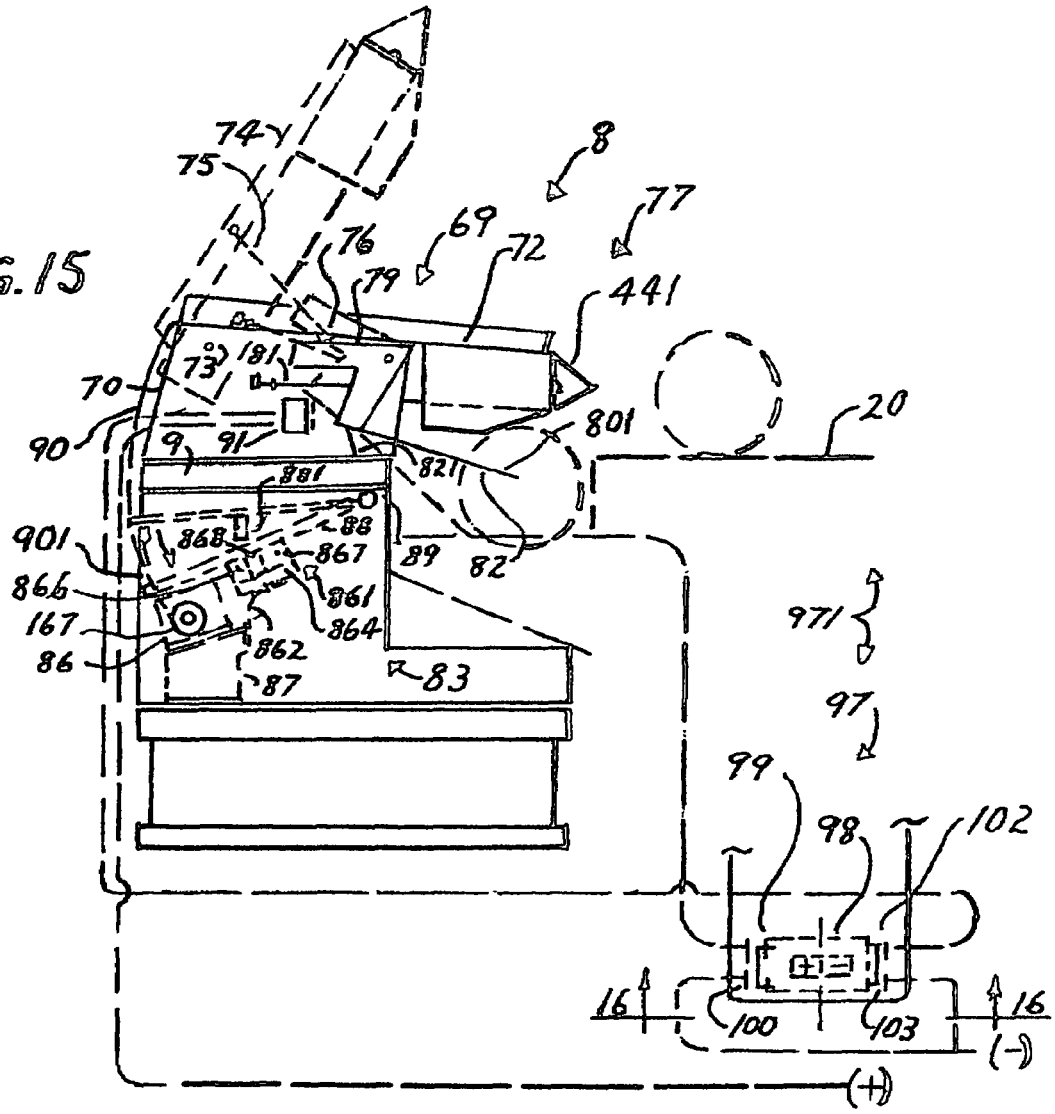
FIG. 15 is an elevation view of a segment pocket unit showing the motor apparatus that is actuated to open a segment pocket, and the electromagnet apparatus that is used to close a segment pocket, by using a remotely located panel, pocket push button, and included is a portrayal of the electrical circuit that is attendant to the operation of the unit apparatus.

Embodiment G-2 FIG. 15.

Continuing the making process, the ball drop closing mechanism (77) apparatus provided here is combined with an electric motor (86), and electro magnetic apparatus (83) that is provided to allow a player to open or close the 21 segment pockets (8) at each end of the playing area (20) by a corresponding push button (84) on a 21 button panel (85), located on the table top, adjacent to where he stands, at one end of the table's (1) playing area surface (20).

And since a player must be able to open or close a segment pocket at either end of the table (1), two 21 button panels are provided at each end of the table (1), one panel for the 21 segment pockets at the immediate table (1) end, and another panel for 21 segment pockets at the remote table (1) end.

Therefore, proceed to provide each segment pocket unit (8), with a segment tongue (72), lift motor (86), that has a pulley (167), on it's shaft, and with a lift motor (86) current cut off switch (861).

A segment lift motor (86) is disposed in an open space beneath the segment support plate (9) as shown in FIG. 15.

The motor (86) is supported by a bracket (87) that is fastened to the top surface of the structural ring (2).

Each motor (86) current cut-off switch (861) is supported by a bracket (862), to motor bracket (87).

The switch unit (861) is comprised of an enclosure box (863) that supports a hinged, electrical contact bar flap (864), a flap tension spring (865), not shown, and a set of bar contacts, a +, and a –, (866), and (867).

Provide a lift lever probe access hole (868) in the enclosure box top (863). Provide a segment tongue lift lever (88), that is hinge (89) fastened, loosely, to the underside of the segment unit (8) support plate (9).

Provide a lift motor (86) current cut-off switch actuating probe (881), mounted, projecting downward, on the underside of the lift lever (88).

An individual segment pocket unit (8) wiring schematic (971) is seen in FIG. 15. Provide a flexible plastic segment tongue lift band (90) that is connected by one end to the top of the segment tongue (72), adjacent the segment hinge pin (73), and by its opposite end to the unfastened end of the segment lift lever (88).

Provide a band (90) extension piece (901), that connects the unfastened end of the segment lift lever (88) to, and is capable of wrapping around the motor (86) pulley (167).

Operationally, when the segment tongue (72) is in the horizontal, down position, the band (90) is near taunt and the lift lever (88) is elevated, and spaced away from the segment lift motor (86).

Again, continuing, provide a ball drop pocket closing mechanism actuator magnet (91), that is disposed, fastened to the side (70) of the segment hinge base (69), beneath and aligned with the bottom surface of the mechanism (77) arm (82), so that while the mechanism cam (79) is hanging loosely, and the segment tongue (72) is elevated, held by lever (75), energizing the ball drop pocket closing mechanism actuator magnet (91) attracts the cam arm (82), attractor bracket (821) and causes the cam (79) to rotate and then displace lever (75) from the groove (76) it is setting in, thereby causing the segment tongue (72) to drop into the closed pocket position.

Figure 16:
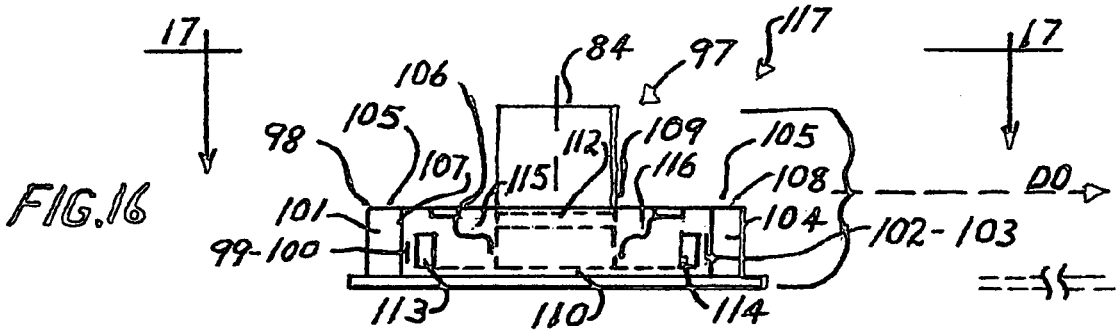
FIG. 16 is a cross section along line 16--16 of the segment pocket, open or close push button panel, shown in FIG. 15, that shows in elevation, a typical segment pocket unit, pocket open, pocket close, switch.
Figure 17:
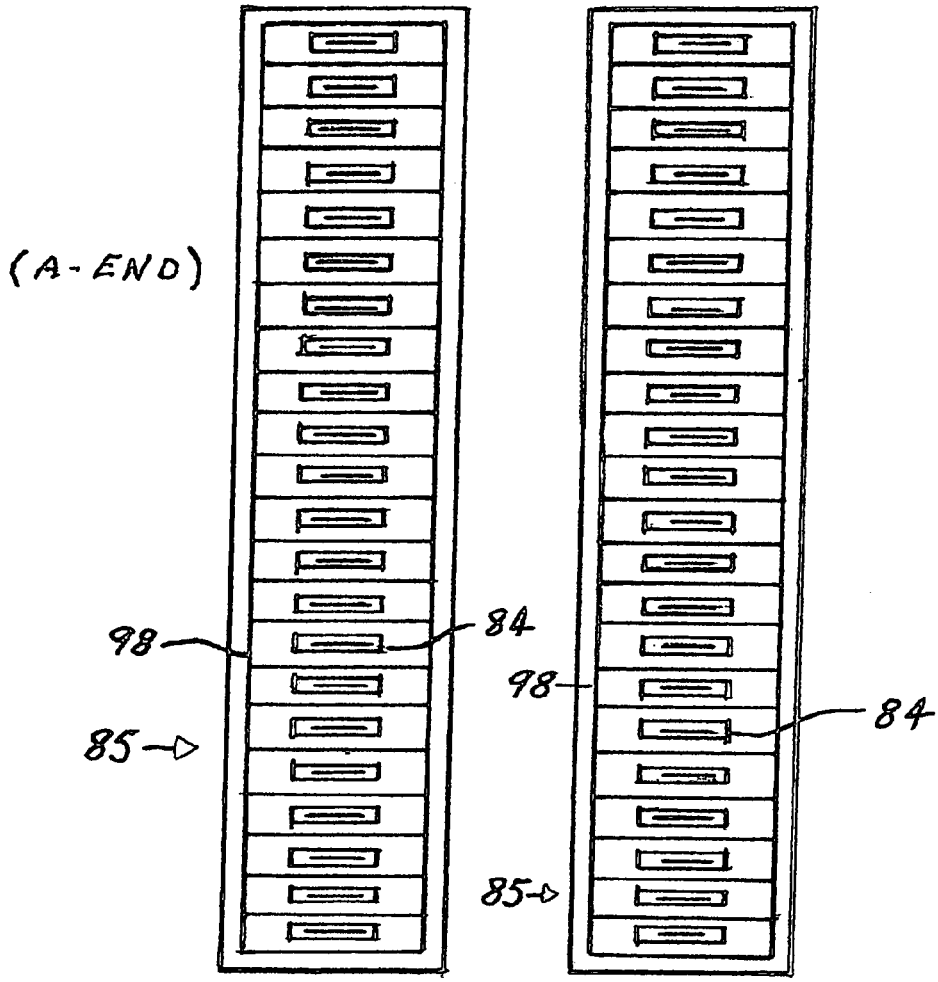
FIG. 17 is a plan view depicting two segment pocket unit electro magnetic control switch panels that are provided at each end of the table's playing area surface. (A-end shown.)

Embodiment H FIGS. 16 & 17.

Provide typical 21 button segment pocket control panels, each comprised of a panel enclosure (85), with 21 combination, segment lift motor (86) actuation switch/pocket closing magnet (91) actuation switch, units (97).

A (97) unit provides a button post actuation of (86) when moved to the left, and actuation of (91), when moved to the right.

The (97) unit while self centering, is provided with a rectangular enclosure housing (98), dual contacts, 99-100, mounted on the vertical face of bracket 101, at one end of the housing (98), and dual contacts 102-103, mounted on the face of bracket 104, at the opposite end of the housing (98), where each bracket is fastened to a vertical end member of the enclosure (98).

Provide each bracket 101 and 104, with a vertical post and retaining nut 105, mounted on its top horizontal member.

Provide the switch unit (97) with an enclosure cover that has two holes (107 & 108) in its top surface that correspond to the vertical posts extending up from the brackets to provide fastening of the cover (106) to the switch enclosure (98).

Provide flat cover (106) with a slot (109) that is cut lengthwise in its center. Provide switch (97) with a sliding contact base plate (110) that can move back and forth on the interior bottom surface of the enclosure (98), between brackets 101 and 104.

Provide switch (97) with a vertical button post (84) fastened to the top center surface of the base plate (110).

The post (84) extends up through the cover slot (109), so that the contact base plate (110) can be moved in a back and forth motion by applying force to the button post.

Provide post (84), carrying a stabilizing fin (112) that extends horizontally out on both sides of the post, just beneath and in touch with the underside of the cover (106), so that when the cover is in place the fin stabilizes the contact base plate (110) in its movement.

Provide base plate (110), carrying a set of conducting contact bars (113 and 114).

Contact bar (113) corresponds to and can make circuit through contacts 99 and 100.

Contact bar 114 corresponds to and can make circuit through contacts 102 and 103.

Provide cover (106), carrying a set of flexing flat springs (115) & (116) that extend downward from the bottom surface of the cover (106), one on each side of and engaging the post, so that the button post assembly (117) always reacts by springing back to its center location in the length of the enclosure (98).

Self centering switch (97) provides circuit through contacts 99, switch (861), and 100 to actuate segment pocket unit (8) primary electromagnet (86), that is to open a segment pocket, and circuit through contacts 102 and 103 to actuate secondary electromagnet (91), that is to close a segment pocket (8).

As indicated above, two panel units (118) are provided at each end of the table (1).

Figure 18:
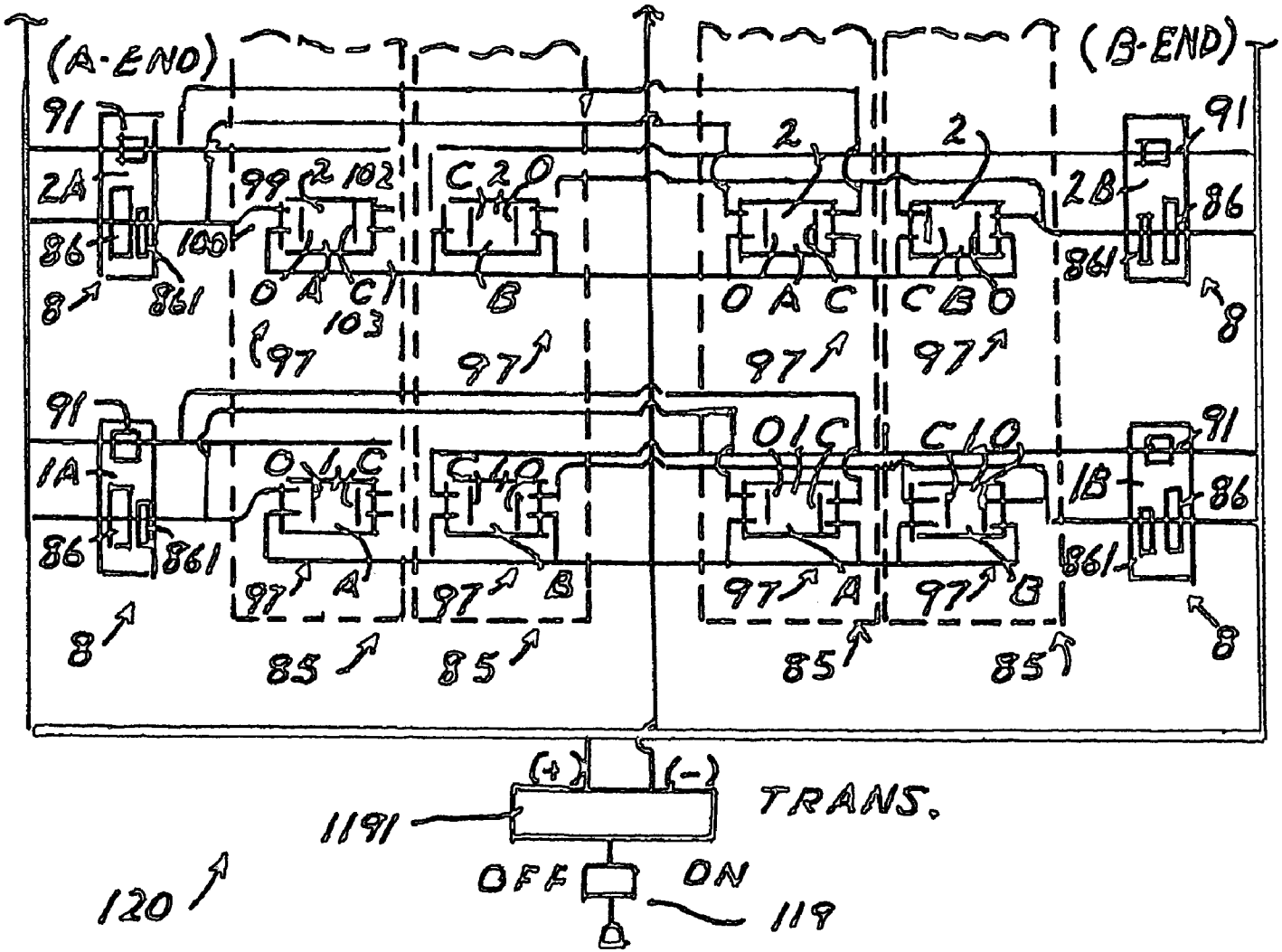
FIG. 18 is an electrical circuit plan view for the invention that shows typical wiring of the invention's segment pocket units, including the switches that open and close these units electro magnetically.

Embodiment FIGS. 1, 15, & 18.

Continuing, provide circuit wiring of a segment pocket unit's (8) electrical apparatus as shown.

According to the circuit shown here, current is provided from a source via an on/off switch (119), to a transformer (1191), and from the transformer to individual segment pocket units (8) via the (85) panel, here further identified as A-circuit, B-circuit switches (97), to and through the electric motor (86), to the + side of incoming current, or to and through electromagnet (91), to the + side of incoming current.

The FIG. 18 wiring schematic (120), shows typical wiring of the 21 individual segment pocket units (8), in 2 side by side switch (97) panels (85), on each end, A-end and B-end, of the table (1).

Embodiment J FIGS. 9, 19A, 19B, & 19C.

Again, continuing, provide two long table skirt panels, 19A (551), two short table skirt panels, 19B (552), and provide two table top panels, 19C (671 and 672).

Provide each top panel (671 and 672), with two fastening blocks (681), that are glued to the bottom surface of each panel.

The blocks facilitate fastening the panels to table skirt bracket tops, by lapping and adjustable clamping. Note that FIG. 9 shows that (681) overlaps the top member (61) of the B bracket.

Figure 20A:
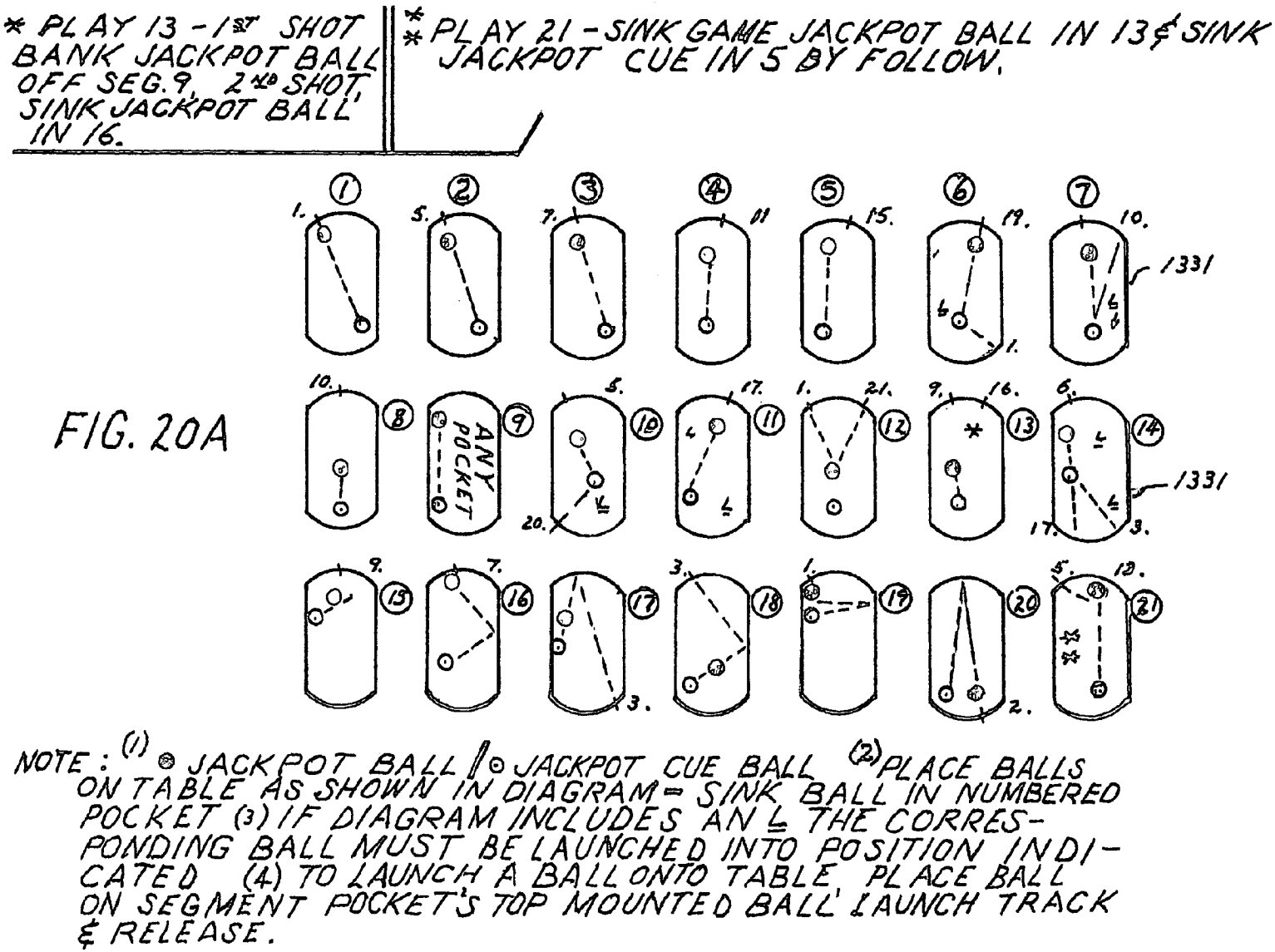
FIG. 20A depicts 21 play diagrams that are printed on the face of the combination Ball Rack/Jackpot Play Selector Wheel unit.
Figure 20B:
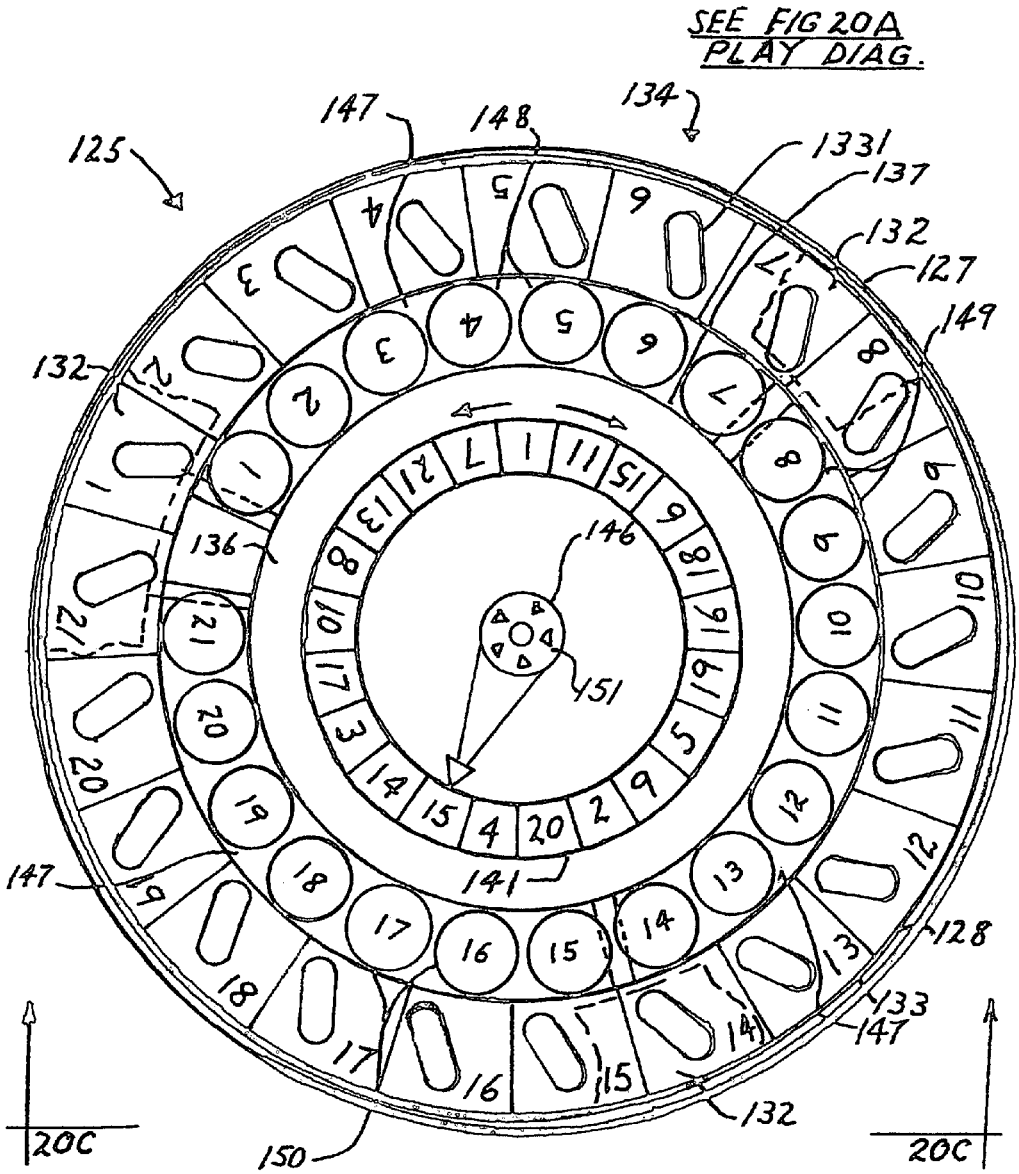
FIG. 20B is a plan view of the table's Ball Rack/Jackpot Play Selector Spinner Wheel.
Figures 20B, 20C:
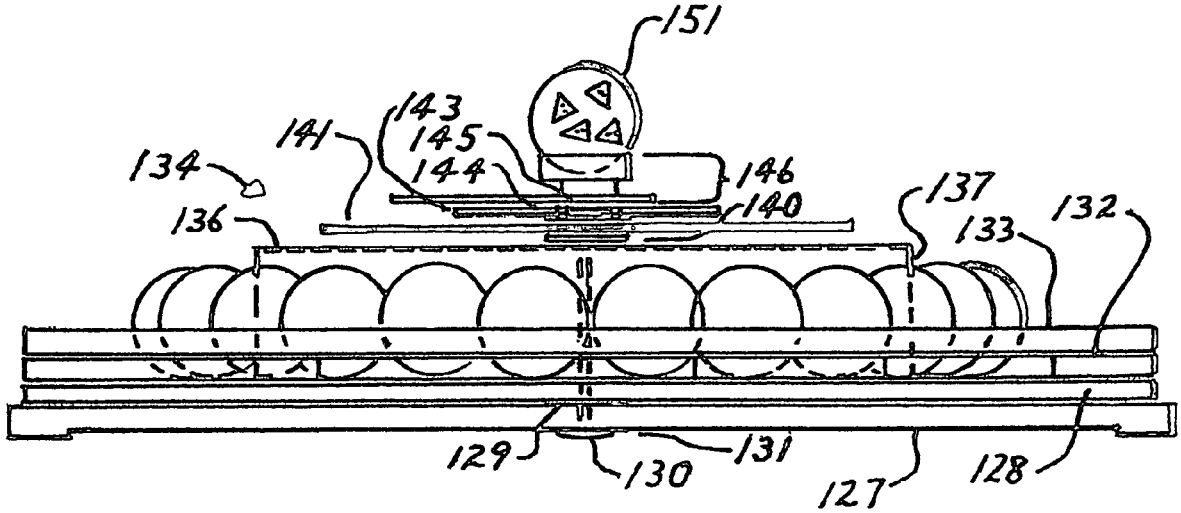
FIG. 20C is an elevation view of FIG. 20B.

Embodiment K 1 FIGS. 20A, 20B, & 20C.

In support of a new Pool Game System, that is played on this improved Pool Game Table, proceed to provide a combination Ball Rack/Jackpot Winning Play Selector unit (125) as follows: drill a center hole (126) in a large base disk (127), and a center hole (126) in a smaller disk (128).

Provide a washer (129) between the base disk (127) and the smaller disk (128), and insert a center post round head thru bolt (130) that has a bottom washer (131), through the center holes of the disks (127 and 128).

Glue a plurality of semicircular flat spacer pieces (132) around the top surface, peripheral edge of the smaller disk (128), and glue a narrow ring (133), that is the same diameter as the smaller disk (128), superimposed on the spacer pieces (132).

Provide portraits of 21 diagramed plays that are numbered 1 thru 21 (1331), equally spaced apart, printed in a circular configuration that corresponds to the top surface of narrow ring (133), perforated accordingly, and then glued to the (133) ring.

Play diagrams 1 to 21 (1331), are shown in FIG. 20 A, and are printed clockwise, in numerical order, as illustrated in FIG. 20 B.

Provide a small diameter support cylinder (134), comprised of two small disks, (135) on bottom, and (136) on top, with a thin wrap around enclosure piece (137) to provide a cylinder (134).

Proceed and drill center holes, (138) in (135), and (139) in (136), and thread the cylinder onto the thru bolt (130).

Stabilize the cylinder (134) by gluing the bottom disk (135) to the top surface of the smaller disk (128).

Place a washer (140) on the center post (130), on top of the cylinder top disk 136, and provide a thin, play numbered spinner disk (141) with a center hole (1421), on the center post (130) washer (140).

Note 1 . . . the distance between the top surface of smaller disk (128) and the bottom surface of spinner disk (141) should be greater than the diameter of a standard pool ball, so that a ball placed on the rack disk (128) will fit under the bottom surface of the spinner disk (141).

See FIG. 20 C.

Divide the spinner disk (141) top surface into 21 equally spaced, same size wedge spaces, and print the numbers 1 to 21, in random mixed order, in the 21 wedge spaces.

Proceed by placing a washer (142) on post (130) above spinner (141), and provide a small diameter top disk (143) with a center post hole (144), that is shaped to retain a stabilizing hex, top of center post, bolt (130, nut (145), in its shaped center hole (144).

Provider a single piece combination, pointer/jackpot ball cup holder (146) glued to the top of disk (143).

As shown in FIGS. 20B and 20C, provide surface space configurations (147) to accommodate racking 7 red standard size pool balls (148), 7 white standard size pool balls (149), and 7 blue standard size pool balls (150), in corresponding spaces on the top surface of the smaller disk, exposed within the inner enclosure created on the surface of (128), by play display ring (133), by gluing thin configuration strips as shown in FIG. 20B.

Provide a jackpot play ball (151), held in cup holder (146).

A prototype jackpot cue ball (151) could be made by randomly printing small triangles (152) in blue, with the letters JP (153) printed in red, within the blue triangles (152).

Figure 21B:
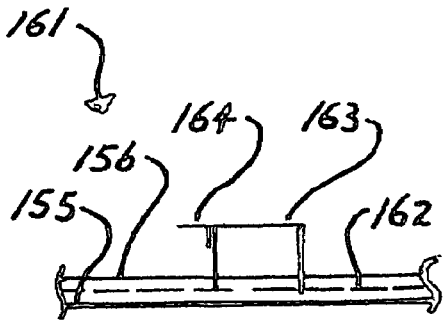
FIG. 21B is an elevation section taken along line 21B-21B of FIG. 21A.
Figure 21A:
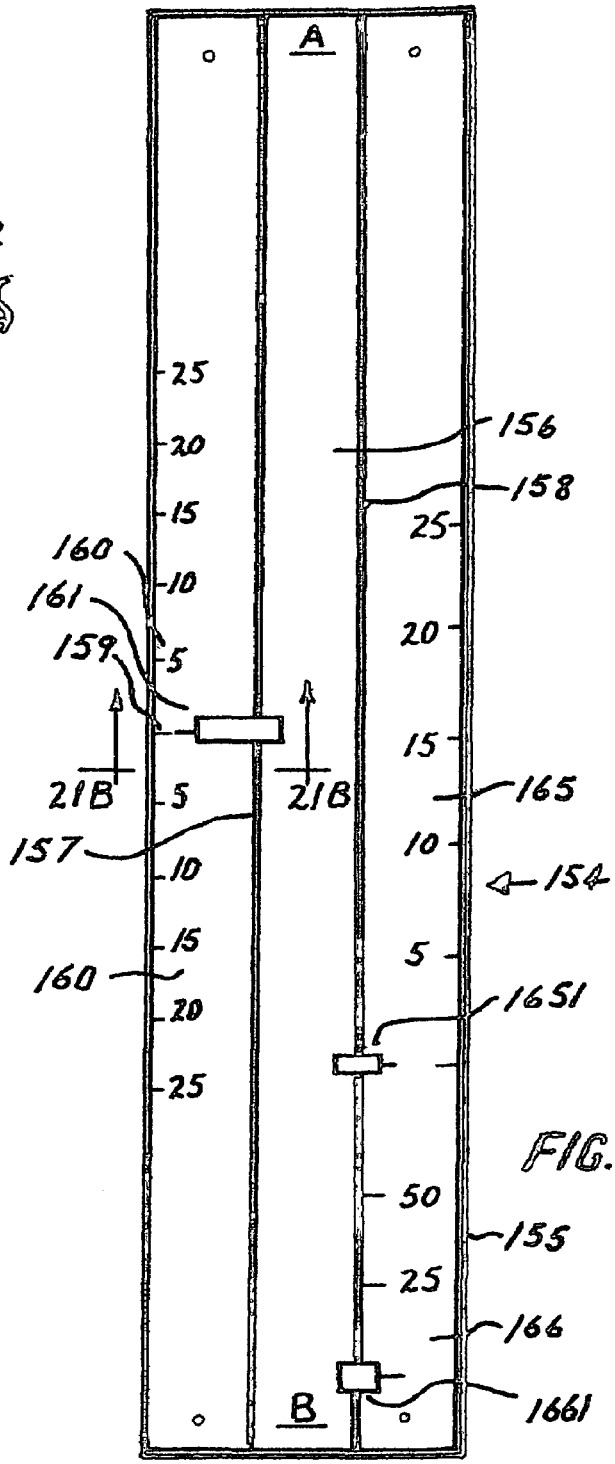
FIG. 21A is a plan view of the game table's multiple sliding arrow pointer score keeping scale.

Embodiment K 2 FIGS. 1, 21A, & 21B.

Again, in further support of the new Pool Game System that is played on this improved Pool Game Table (1), provide a multi-slide score recording scale unit (154), as follows.

Provide a counting scale unit base plate (155), with a superimposed slotted cover plate (156), that embodies two parallel narrow lengthwise slots (157) on the left, and (158) on the right.

Fasten the cover plate (156) spaced by washers, to the base plate (155), using small diameter bolts with nuts, adjacent the unit's corners.

At the top of the unit (154), print A-End, and at the bottom of the unit print B-End. This corresponds to the A and B ends of the table (1).

Along the left side of unit (154's) slot (157), print a scale zero marker bar (159), at the center of slot (157's) length, On each side of the bar (159), print marker bars (160) that are equally spaced away from the zero marker bar arrow (159), on each side of the zero bar (159), providing 20 bars, and allowing 5 marks between bars.

Provide a sliding count marker (161), with a flat thin plastic rectangular shaped slide base (162), a stabilizer block (163) glued to the center top surface of the slide base (162), and a top arrow point indicator (164), pointing toward the left side of the unit (154). See FIG. 21B.

Note:

It is intended that in using this slide counter (154), if the player at A end of the playing surface (20) scores a point, the counter would be moved to the # 1 bar marker (160) at the beginning of the scale, and if the player at B end of the playing surface (20) then scores a point, the counter would be moved back to the zero marker bar (159), to indicate that the score was tie, and so on.

Along the right side of unit (154's) slot (158), print two jackpot point slide marker scales, a (165) scale which starts approximately ¼ the distance from the unit's (154) bottom edge, and extends to near the top of the unit, and a (166) scale, which starts just below the (165) scale and extends to the bottom of the unit (154).

Provide a slide counter (1651) for the (165) scale, and a slide counter (1661) for the (166) scale, each made the same as the (161) slide counter. Along the right side of unit (154's) slot (158), print a scale showing 25 marker bars that are equally spaced apart, and correspond to the (165) scale.

Again, along the right side of unit (154's) slot (158), print a scale showing two marker bars that are equally spaced apart, bearing the numbers 25, and 50, respectively, so that after 25 jackpot points have been registered on the (165) scale, (166) scale slide counter can be set on 25, and the (165) slide counter (1651) can be reset back on zero, as a game continues.

Embodiment K 3 FIGS. 1, 20B, 20C, & 21A.

This game table improvement invention has motor and electro magnetically powered segment pocket units (8), 21 units at each end of its elongated playing surface area (20), that can be opened and closed by table top panel supported push button switches (97).

This new invention can be used to play the new game system of pool that is called 7 CUE.

The new 7 CUE game uses 21 consecutively numbered pool balls, 7 Red (148), 7 White (149), & 7 Blue (150), plus a specially marked Jackpot Cue ball (151), and 2 standard players pool cues.

The game is played in 3 parts.

The balls are racked using the combination Rack/Jackpot Winning Play Selector Unit (125).

Players spin the play selector wheel (141) to randomly determine who will go first.

Part 1 of the game is started by the starting player, who launches the 7 red balls (148) onto the table (1) play surface (20).

The 1$^{st}$ player tries to sink the 7 balls--- start with #1, * RULE—always use a higher numbered ball as your cue ball. Call a pocket by number, open the pocket, try to sink the ball in the pocket opened.

* RULE—when a player sinks a ball, add a point to his score, and when a player misses, add a point to the Jackpot Points score.

If the 1$^{st}$ player misses, continue by allowing the 2$^{nd}$ player to try and sink the lowest # ball.

Continue play.

* RULE—the player who sinks the #6 ball, proceeds to retrieve the #7 ball, which is referred to as Jackpot Game Ball 7, from the table (1) play surface (20), and spins the Jackpot Winning Play Selector wheel (141), to determine, which play must be made of the 21 diagramed plays (1331) pictured on the face of the play selector unit (125), in order to win the scored Jackpot Points.

Continue play.

The player closes the open pocket (8), sets up the Jackpot Play using the #7 red Jackpot Game Ball, and the Jackpot Cue Ball (151) and executes the play.

* Rule—if the player sinks the #7 Jackpot Game ball using the diagramed play, he is awarded 1 game point and the Jackpot Points shown on the score scale (154), If the player misses the diagramed play, the players opponent sets up and tries the same play, and if he sinks the #7 he is awarded 2 game points + the Jackpot Points shown on the score scale.

If the opponent also misses, the #7 is left on the table (1) and 2 points, 1 for each miss, are added to the Jackpot Score.

Part 2 of the game is started.

The player who has a turn, proceeds to launch white balls #8 through #14 onto the table (1) play surface (20).

In this part of the game, the player who sinks the #13 ball, retrieves the #14 Jackpot Game Ball from the table (1) play surface (20), and spins the Jackpot Play Selector Wheel (141) to determine which play (1331) must be made in order to win the Jackpot Points.

The player then proceeds to set up his Jackpot Play using the #14 Jackpot Game Ball and the Jackpot Cue Ball (151).

Part 2 of the game is concluded with either player sinking the #14 Jackpot Game Ball, and winning the Jackpot Points, or if neither player sinks the Ball, the #14 Ball is left on the table, and the Jackpot Points are carried forward.

Part 3 of game play is started by launching the blue balls, #15 through #21, onto the table (1) play area (20).

The player who sinks the #20 Jackpot Game Ball, retrieves the #21 Jackpot Game Ball from the table, and spins the Jackpot Play Selector wheel (141), to determine which play must be made in order to win the Jackpot Points.

The Jackpot Play is set up using the #21 Jackpot Game Ball and the Jackpot Cue Ball (151), and executed.

If the player fails to sink the #21 Ball, his opponent tries the same shot.

If the opponent sinks the #21 Ball, he is awarded 1 Game Point and the total remaining points in the Jackpot.

* RULE—if neither player sinks the #21 Jackpot Game Ball, after both players have taken a turn, the #21 segment pocket (8) at the A end of the table (1), and the #21 segment pocket (8) at the B end of the table (1), are opened, and the Jackpot Points are awarded to the player who sinks the #21 Jackpot Game Ball in one of these pockets (8).

At the end of Part 3 Game Play, the player with the highest point total is the 7 CUE Game Winner

I claim:

1. An improved pool table comprising, a round pool table having an elongated playing surface, a horizontal, flat circular structural frame member that resembles an I-shape in section, supported by four triangular shaped legs, said structural member supporting all of the components of said round pool table, including:

a flat, semicircular, segment pocket unit supporting base plate, supported by a plurality of vertical twin brackets at each end of said elongated playing surface, a semicircular ball drop deflector plate, spaced below each said segment pocket unit supporting base plate, blocked-up, and disposed sloping down, toward said table's center, supported by horizontal base extensions of said vertical twin brackets, a semicircular ball return trough plate that corresponds to and is spaced below each said ball deflector plate, supported at a high end by a rectangular, flat, horizontal plate bracket, to a top surface of a structural ring frame, and supported at a low end by another horizontal plate bracket to a bottom surface of said structural ring frame, a ball return trough plate rail, supported by vertical posts, fastened along an interior edge of each trough plate, a ball return trough extension unit, comprising, a near horizontal bottom member, with vertical side piece members, suspended from said structural ring frame between the low ends of said return trough plates, and extending at its low end into said structural ring frame supported ball return collector pan, a laminated horizontally disposed playing surface area plate unit, supported at each end by a cross-beam member supported at each end by an adjustable bracket clamped to said structural ring frame, a pair of corresponding, elongated, playing area side cushions, each comprising a structural cushion base member supported at each end by a horizontal arm that is supported by an adjustable bracket clamped to said structural ring frame, a plurality of vertical table enclosing skirt brackets that are through bolted to said structural ring frame, a plurality of table enclosing skirt members that are disposed vertically, and through bolted to said skirt brackets, two top of table enclosing plates, each fastened by blocks to the top of said skirt brackets, a plurality of segment pocket units, supported at first and second ends of said playing area, each unit comprised of a base assembly having a horizontal base member and two vertical, parallel, side members that support a cushioned segment tongue the segment pocket unit on a hinged pin, a segment pocket unit, mechanical ball drop, pocket closing mechanism, comprised of a cam carried loosely, on a pin set horizontally in segment pocket unit's right vertical side member, a weighted cam counterbalance, and a rectangular ball drop pan, carried on a cam arm, that extends into the vertical pocket space between the segment pocket unit and said table playing area, segment pocket unit electrical apparatus that includes a bracket supported motor that has a pulley on its shaft, which pulls a lever connected by the unfastened ends of the lever to the fastened end of said segment tongue by a flexible plastic band, and facilitates opening said segment pocket when said band becomes wound on said pulley; a current cut-off switch carried on said lever, and actuated when said segment tongue has been elevated to an elevation where the segment tongue's hold-lever engages a groove in the top surface of said segment pocket unit's right vertical side member, and keeps the tongue elevated, segment pocket unit electromagnet pocket closing apparatus comprised of a bracket supported electromagnet that is fastened to the side of said segment pocket unit, aligned with an attractor bracket mounted on said cam, wherein when actuated attracts said attractor bracket, causing said cam to rotate, and thereby displace said segment tongue's hold lever from its hold groove, thereby causing the segment tongue to drop into a closed pocket position, two switch panels at each end of the table's elongated playing area, panel 1 and panel 2 at the first end, and panel 3 and panel 4 at the second end, where panel 1 has a plurality of on/off/on switches to control the actuation of the motor, and pocket closing electromagnet of each segment pocket unit, which to controls the opening and closing of the segment pocket units at the first end of said playing area, and where in panel 2 has a plurality of on/off/on switches to control the actuation of the pocket opening motor and pocket closing electromagnet of each segment pocket unit, which controls the opening and closing of the segment pocket units at the second end of said playing area, and correspondingly, wherein panel 3 has a plurality of on/off/on switches, for controling the actuation of the pocket opening motor and pocket closing electromagnet of each segment pocket unit, which controls the opening and closing of the segment pocket units at the second end of said playing area, and wherein panel 4 has a plurality of on/off/on switches for controling the actuation of the pocket opening motor and pocket closing electromagnet of each segment pocket unit, which controls the opening and closing of the segment pocket units, at the first end of said playing area, a combination Ball Rack/Jackpot Play Selector Wheel unit, which holds 21 standard pool balls, and a Jackpot Cue Ball, and further carries a printed display of 21 diagramed, and number identified plays, arranged clockwise, 1 to 21, which is used to select a Jackpot Point Winning Play, by spinning a numbered disk wheel, and a multiple sliding arrow game point and Jackpot point score keeping scale.

2. The improved pool table of claim 1, wherein said segment pocket unit base plate supporting brackets are L-shaped and deployed, spaced apart, in pairs, resting on the top surface of said structural ring frame, and wherein said semicircular base plate, when resting horizontally on the horizontal top members of the plurality of arrayed brackets, is through bolted to said structural ring frame so a stable horizontal platform is provided as a mounting base for the plurality of segment pocket units that are fastened thereto.

3. The laminated playing surface area plate of claim 1, wherein said plate's bottom panel has four vertical rectangular shaped fastening brackets, extending down from its bottom panel, and spaced in respective attachments, to facilitate flexible connection of said plate to said cross-beam.

4. The cross beam support brackets of claim 1, wherein each said bracket has a vertically suspended take-up bolt having a finger tightened wing nut, which passes vertically through said support beam, to allow vertical elevation or lowering adjustments of beam-ends engaged to said bracket.

5. The structural cushion base member of claim 1, wherein said member is connected to each said arm by a vertical bolt passes vertically through said arm and through a horizontal slot in cushion base member, and through a top of assembly slide plate, and a bottom of assembly slide plate, so that said base member can be adjustably stabilized in its horizontal positioning.

6. The horizontal cushion base support arm of claim 1, wherein said arm is carried between the vertical members of a bracket, fastened at their lower end by through bolt to a horizontal base member fastened to a square plate clamped to said structural frame member, and wherein said vertical members have a transverse take-up bolt with a winged nut, spaced below the bottom surface of said arm, wherein said arm can be stabilized, flexibly, in said fastening bracket.

7. The segment pocket unit of claim 1, wherein a segment elevation hold lever is carried on the top of each segment tongue, and wherein when said segment lift motor is actuated, the lever's end trails along the top surface of said unit's right side member, overriding a slot in the member's top surface, and wherein when said segment tongue lilt-motor is stopped by said current cut-off switch, the hold lever falls back a short distance and drops into said slot and holds the segment tongue elevated.

8. The pocket closing mechanism cam of claim 1, wherein said pocket closing electromagnet's actuation causes said cam to rotate into engagement with said elevation hold lever, and dislodges said cam from said groove, thereby causing said pocket to close.

9. The segment tongue lift motor current cut-off switch of claim 1, wherein said cut-off switch is engaged by a probe on said lever wherein when actuated, penetrates a switch enclosure box, and displaces the switch's hinged electrical contact bar flap from a contact bridging disposition, causing the circuit provided by the switch to be broken.

10. The on/off/on switch of claim 1, wherein each said electromagnetic switch is a sell centering mechanism that actuates said unit segment pocket opening lift motor when its button post is pressed to the left, and when released returns to its neutral center point of origin, and actuates a segment pocket closing secondary electromagnet when its button post is pressed to the right, and again when released returns to its neutral center point of origin.

11. The switch panels of claim 1, wherein each panel has 21 segment pocket on/off/on switch units that control turning the pocket opening lift motor on, turning the switch off, and turning the pocket closing electromagnet on.

12. The I-shape resembling structural frame member of claim 1, wherein said frame section is comprised of parallel, congruent, semicircular-section horizontal member plates that are held spaced apart by a plurality of semicircular sections, vertical member ribs, that are stabilized by a plurality of elongated, square, shaped, block, brackets, at vertical and horizontal member intersections, wherein various members of the unit construction are glued together in an I-shaped ¼ unit of an entire ring.

13. The numbered disk wheel of claim 1, wherein said wheel's 21 numbers are printed in random sequence around the peripheral edge of the wheel's face, and correspond to the 21 diagramed, numbered, plays that are printed in clockwise order on the peripheral edge of the units base supported ring.

14. The multiple sliding arrow, score keeping scale of claim 1, wherein a first sliding arrow indicates the running balance of player game points, that indicate the current game score as -0-, or shows the point total for the player leading the game, a second sliding arrow indicates the cumulative Jackpot Point total recorded during a game, and a third sliding arrow can be moved to a point-in-game Jackpot Point total, so the second sliding arrow can be reset at -0- as the game continues.

* * * * *